US007416185B2

(12) United States Patent
Clark

(10) Patent No.: US 7,416,185 B2
(45) Date of Patent: Aug. 26, 2008

(54) INVERTER WITH RETURN/BYPASS PAPER PATH

(75) Inventor: Robert A. Clark, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 425 days.

(21) Appl. No.: 11/090,498

(22) Filed: Mar. 25, 2005

(65) Prior Publication Data

US 2006/0214359 A1 Sep. 28, 2006

(51) Int. Cl.
*B65H 39/10* (2006.01)

(52) U.S. Cl. ..... 271/291; 271/65; 271/186

(58) Field of Classification Search ..... 271/291, 271/301, 65, 186
See application file for complete search history.

(56) References Cited

U.S. PATENT DOCUMENTS

| | | | | |
|---|---|---|---|---|
| 4,579,466 | A | 4/1986 | Sato | |
| 4,587,532 | A | 5/1986 | Asano | |
| 4,692,020 | A * | 9/1987 | Tsujihara | 399/401 |
| 4,836,119 | A | 6/1989 | Siraco | |
| 4,971,304 | A | 11/1990 | Lofthus | |
| 5,080,340 | A | 1/1992 | Hacknauer | |
| 5,095,342 | A | 3/1992 | Farrell | |
| 5,159,395 | A | 10/1992 | Farrell | |
| 5,208,640 | A | 5/1993 | Horie | |
| 5,272,511 | A | 12/1993 | Conrad | |
| 5,326,093 | A | 7/1994 | Sollitt | |
| 5,389,969 | A | 2/1995 | Suzuki | |
| 5,435,544 | A | 7/1995 | Mandel | |
| 5,473,419 | A | 12/1995 | Russel | |
| 5,504,568 | A | 4/1996 | Saraswat | |
| 5,525,031 | A | 6/1996 | Fox | |
| 5,557,367 | A | 9/1996 | Yang | |
| 5,568,246 | A | 10/1996 | Keller | |
| 5,570,172 | A | 10/1996 | Acquaviva | |
| 5,596,416 | A | 1/1997 | Barry | |
| 5,629,762 | A | 5/1997 | Mahoney | |
| 5,710,968 | A | 1/1998 | Clark | |
| 5,778,377 | A | 7/1998 | Marlin | |
| 5,884,910 | A | 3/1999 | Mandel | |
| 5,995,721 | A | 11/1999 | Rourke | |
| 6,059,284 | A | 5/2000 | Wolf | |
| 6,125,248 | A | 9/2000 | Moser | |
| 6,241,242 | B1 | 6/2001 | Munro | |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—David H Bollinger
(74) *Attorney, Agent, or Firm*—Eugene O. Palazzo; Fay Sharpe LLP

(57) ABSTRACT

A printing system and method is provided incorporating inverter assemblies for not only selectively inverting media during transport through the system but also to register the media and provide a velocity buffer transport. The selective inverter assemblies include the capability to optionally deskew the media and provide lateral registration corrections. The inverter assembly nip rollers are sufficiently spaced from process drive nip rollers to decouple a document in the inverter assembly from the highway paths. The method comprises combining the inverting function selectively with registering, velocity buffering, and sequencing functions.

26 Claims, 5 Drawing Sheets

U.S. PATENT DOCUMENTS

| | | | |
|---|---|---|---|
| 6,297,886 | B1 | 10/2001 | Cornell |
| 6,384,918 | B1 | 5/2002 | Hubble, III |
| 6,450,711 | B1 | 9/2002 | Conrow |
| 6,476,376 | B1 | 11/2002 | Biegelsen |
| 6,476,923 | B1 | 11/2002 | Cornell |
| 6,493,098 | B1 | 12/2002 | Cornell |
| 6,537,910 | B1 | 3/2003 | Burke |
| 6,550,762 | B2 | 4/2003 | Stoll |
| 6,554,276 | B2 | 4/2003 | Jackson |
| 6,577,925 | B1 | 6/2003 | Fromherz |
| 6,607,320 | B2 | 8/2003 | Bobrow |
| 6,608,988 | B2 | 8/2003 | Conrow |
| 6,612,566 | B2 | 9/2003 | Stoll |
| 6,621,576 | B2 | 9/2003 | Tandon |
| 6,633,382 | B2 | 10/2003 | Hubble, III |
| 6,639,669 | B2 | 10/2003 | Hubble, III |
| 6,819,906 | B1 | 11/2004 | Herrmann |
| 2002/0078012 | A1 | 6/2002 | Ryan |
| 2002/0103559 | A1 | 8/2002 | Gartstein |
| 2003/0077095 | A1 | 4/2003 | Conrow |
| 2004/0085561 | A1 | 5/2004 | Fromherz |
| 2004/0085562 | A1 | 5/2004 | Fromherz |
| 2004/0088207 | A1 | 5/2004 | Fromherz |
| 2004/0150156 | A1 | 8/2004 | Fromherz |
| 2004/0150158 | A1 | 8/2004 | Biegelsen |
| 2004/0153983 | A1 | 8/2004 | McMillan |
| 2004/0216002 | A1 | 10/2004 | Fromherz |
| 2004/0225391 | A1 | 11/2004 | Fromherz |
| 2004/0225394 | A1 | 11/2004 | Fromherz |
| 2006/0071406 | A1 * | 4/2006 | Spencer et al. ..... 271/186 |

OTHER PUBLICATIONS

Desmond Fretz, "Cluster Printing Solution Announced", Today at Xerox (TAX), No. 1129, Aug. 3, 2001.

* cited by examiner

INVERTER WITH RETURN/BYPASS PAPER PATH

CROSS REFERENCE TO RELATED PATENTS AND APPLICATIONS

The following applications, the disclosures of each being totally incorporated herein by reference are mentioned:

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Application Ser. No. 60/631,656, filed Nov. 30, 2004, entitled "MULTI-PURPOSE MEDIA TRANSPORT HAVING INTEGRAL IMAGE QUALITY SENSING CAPABILITY," by Steven R. Moore;

U.S. Provisional patent application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional patent application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. Application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. Application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. Application Ser. No. 10/860,195, filed Aug. 23, 2004, entitled "UNIVERSAL FLEXIBLE PLURAL PRINTER TO PLURAL FINISHER SHEET INTEGRATION SYSTEM," by Robert M. Lofthus, et al.;

U.S. Application Ser. No. 10/881,619, filed Jun. 30, 2004, entitled "FLEXIBLE PAPER PATH USING MULTIDIRECTIONAL PATH MODULES," by Daniel G. Bobrow.;

U.S. Application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. Application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. Application Ser. No. 10/924,106, filed Aug. 23, 2004, for PRINTING SYSTEM WITH HORIZONTAL HIGHWAY AND SINGLE PASS DUPLEX by Lofthus, et al.;

U.S. Application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. Application Ser. No. 10/924,458, filed Aug. 23, 2004 for PRINT SEQUENCE SCHEDULING FOR RELIABILITY by Robert M. Lofthus, et al.;

U.S. patent application Ser. No. 10/924,459, filed Aug. 23, 2004, entitled "PARALLEL PRINTING ARCHITECTURE USING IMAGE MARKING DEVICE MODULES," by Barry P. Mandel, et al;

U.S. patent application Ser. No. 10/933,556, filed Sep. 3, 2004, entitled "SUBSTRATE INVERTER SYSTEMS AND METHODS," by Stan A. Spencer, et al.

U.S. patent application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. Application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. patent application Ser. No. 10/999,450, filed Nov. 30, 2004, entitled "ADDRESSABLE FUSING FOR AN INTEGRATED PRINTING SYSTEM," by Robert M. Lofthus, et al.;

U.S. patent application Ser. No. 11/000,158, filed Nov. 30, 2004, entitled "GLOSSING SYSTEM FOR USE IN A TIPP ARCHITECTURE," by Bryan J. Roof;

U.S. patent application Ser. No. 11/000,168, filed Nov. 30, 2004, entitled "ADDRESSABLE FUSING AND HEATING METHODS AND APPARATUS," by David K. Biegelsen, et al.;

U.S. patent application Ser. No. 11/000,258, 20040503Q-US-NP), filed Nov. 30, 2004, entitled "GLOSSING SYSTEM FOR USE IN A TIPP ARCHITECTURE," by Bryan J. Roof;

U.S. Application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. Application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. Application Ser. No. 11/051,817, filed Feb. 4, 2005, entitled "PRINTING SYSTEMS," by Steven R. Moore, et al.;

U.S. Application Ser. No. 11/XXX,XXX, filed Feb. 28, 2004, entitled "PRINTING SYSTEMS," by. Robert M. Lofthus, et al.;

U.S. Application Ser. No. 11/XXX,XXX, filed Mar. 2, 2005, entitled "GRAY BALANCE FOR A PRINTING SYSTEM OF MULTIPLE MARKING ENGINES," by R. Enrique Viturro, et al.; and, U.S. Application Ser. No. 11/XXX,XXX, filed Mar. 16, 2005, entitled "MULTI-PURPOSE MEDIA TRANSPORT HAVING INTEGRAL IMAGE QUALITY SENSING CAPABILITY," by Steven R. Moore; and, U.S. Application Ser. No. 11/XXX,XXX, filed Mar. 25, 2005, entitled "ENHANCED LATERAL SHEET REGISTRATION WITHIN A MEDIA INVERTER" by Robert A. Clark which is incorporated herein by reference.

BACKGROUND

The present exemplary embodiments relate to media (e.g., document or paper) handling systems and systems for printing thereon and is especially applicable for a printing system comprising a plurality of associated xerographic devices or marking engines.

Printing systems including a plurality of marking engines are known and have been generally referred to as tandem engine printers or cluster printing systems. See U.S. Pat. No. 5,568,246. Such systems especially facilitate expeditious duplex printing (both sides of a document are printed) with the first side of a document being printed by one of the marking engines and the other side of the document being printed by another so that parallel printing of sequential documents can occur. The process path for the document usually requires an inversion of the document (the leading edge is reversed to become the trailing edge) to facilitate printing on the back side of the document. Inverter systems are well known and essentially comprise an arrangement of nip wheels or rollers which receive the document by extracting it from a main process path, then direct it back on to the process path after a 180° flip so that what had been the trailing edge of the document now leaves the inverter as the leading edge along the main process path. Inverters are thus fairly simple in their functional result; however, complexities occur as the printing system is required to handle different sizes and types of documents and where the marking engines themselves are arranged in a parallel printing system to effect different types of printing, e.g., black only printing versus color or custom color printing.

As a document is transported along its process path through the system, the document's precise position must be known and controlled. The adjustment of the documents to desired positions for accurate printing is generally referred to as a registering process and the apparatus used to achieve the process are known as registration systems. See U.S. Pat. No. 4,971,304, which is incorporated herein by reference. Precision registration systems generally comprise nip wheels in combination with document position sensors whereby the position information is used for feedback control of the nip wheels to adjust the document to the desired position. It can be appreciated that many registration systems require some release mechanism from the media handling path upstream of the nip registration wheels so that the wheels can freely effect whatever adjustment is desired. This requires a relatively long and expensive upstream paper handling path. In parallel printing systems using multiple marking engines, the required registration systems also adds to the overall media path length. As the number of marking engines increases, there is a corresponding increase in the associated inverting and registering systems. As these systems may be disposed along the main process path, the machine size and paper path reliability are inversely affected by the increased length of the paper path required to effectively release the documents for registration. Lateral paper registration requirements for containerized marking engines are challenging due to the need to accommodate both edge-registered and center-registered marking engines.

Another disadvantageous complexity especially occurring in parallel printing systems is the required change in the velocity of the media/document and/or desired sequencing, as it is transported through the printing system. As the document is transported through feeding, marking, and finishing components of a parallel printing system, the process speed along the media path can vary to a relatively high speed for transport along a highway path, but must necessarily be slowed for some operations, such as entering the transfer/marking system apparatus. Effective apparatus for buffering such required velocity changes and/or re-sequencing of the media also requires an increase in the main process path to accommodate document acceleration, deceleration, and sequencing between the different sections of the process path.

Especially for parallel printing systems, architectural innovations which effectively shorten the media process path, enhance the process path reliability and reduce overall machine size are highly desired. Additionally, it is desirable to have inverters that can do more than simply invert paper, for example, translate, deskew, buffer, re-sequence, and/or return media to a process path (inverted or non-inverted).

In normal operation, sheets will be fed into the high speed highway and taken off to either be printed or to be sent to a finishing device. Depending upon the arrangement of marking engines used, a sheet could travel a significant distance before it is diverted off the highway. Given the fact that sheet registration degradation is likely proportional to length of paper path traveled, it is believed that the sheet may have a significant amount of mis-registration by the time it exits the highway. At this point, the only registration devices are those currently designed into the input inverters.

BRIEF SUMMARY

The proposed development comprises a selectively enabled inverter disposed in a parallel printing system for accomplishing necessary document handling functions above and beyond the mere selective document inversion function. The combined functions also include velocity buffering and registration within the inverter assembly and a return path for yielding a more compact and cost effective media path.

A printing system is provided comprising a xerographic device or marking engine and a document transport highway path. The system further comprises an inverter including an input path and selectively reversing inverter rollers whereby media sheets move from the transport highway path to the input path. The inverter further includes a first output path having a return path whereby selected ones of media sheets move in a forward direction through the input path and non-inverted in same said forward direction through the first output path and the return path to the transport highway path.

A plural marking engine system is provided including inverter assemblies associated with ones of the marking engines. The inverter assemblies include independent variable speed process direction motors associated with independently driven and selectively reversing nip rollers for non-inverting select ones of media sheets and inverting select other ones of media sheets through the inverter assembly at selectively variable speeds.

An inverter apparatus associated with a marking engine is provided for selectively inverting a document for transport along a media path. The apparatus comprises an inverter having selectively reversing inverter rollers, an input path, and a first output path. The first output path further includes a return path whereby selected ones of media sheets move in a forward direction through the input path and are passed through in the same forward direction through the first output path and the return path. The inverter further includes a second output path whereby selected other ones of media sheets move inverted in a reverse direction through the second output path.

A method is provided of processing a document for transport through a printing system for enhancing document control and reducing transport path distance. The printing system includes an inverter assembly comprising variable speed drive motors associated with nip drive rollers for grasping documents, and a marking engine. The method comprises removing the documents from a transport highway path and transporting the documents into a selective inverter assembly in a forward direction. The method further comprises transporting selected ones of the documents out of said selective inverter assembly in a non-inverted orientation to the transport highway path in the same forward direction.

The document staging or sequencing occurs when a document is received from a main highway path and transported into a selective inverter. The ingress to the inverter can be in one direction, while the egress can be in the same one direction or in another reverse direction. Egress of a document in the same one direction moves the document into a return path where at least one document can be staged (and re-sequenced) until its return to the highway path.

The selective inverter apparatus can perform document registration while the document is in the inverter assembly.

The inverter assembly effectively senses the documents position during ingress, decouples the document from the media process path so that only the inverter holds the document independently of the process path nip rollers. The inverter nips then can be controlled so as to affect process, cross-process, and/or deskew positioning of the document during ingress -and egress, thereby effectively completing all the necessary registration functions while simultaneously and selectively accomplishing an inverting function or a non-inverting function.

The embodiments described herein can effectively combine the functions of selective inverting, velocity buffering, registering, staging, and sequencing in the same inverter assembly for even more enhanced efficiency and size reductions in the paper handling path and overall machine size.

DETAILED DESCRIPTION OF THE EXEMPLARY EMBODIMENTS

Figure 1:
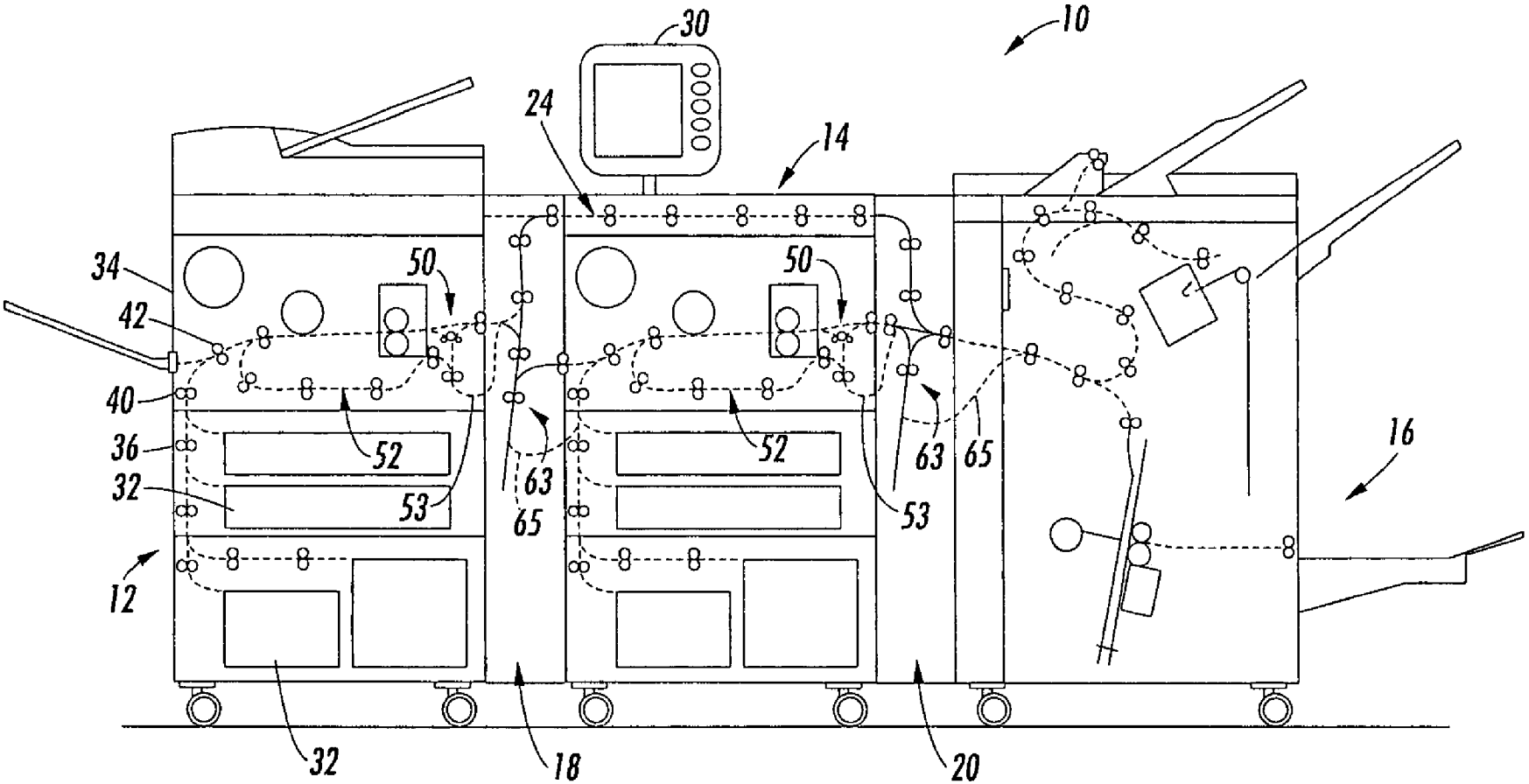
FIG. 1 shows a schematic view of a printing system illustrating selective architectural embodiments of the subject developments.

With reference to the drawings wherein the showings are for purposes of illustrating alternative embodiments and not for limiting same, FIG. 1 shows a schematic view of a printing system comprising a plurality of marking engines associated for tightly integrated parallel printing of documents within the system. More particularly, printing system 10 is illustrated as including primary elements comprising a first marking engine 12, a second marking engine 14 and a finisher assembly 16. Connecting these three elements are three transport assemblies 18, 24 and 20. The document outputs of the first marking engine 12 can be directed either up and over the second marking engine 14 through horizontal by-pass path 24 and then to the finisher 16. Alternatively, where a document is to be duplexed printed, the first vertical transport 18 can transport a document to the second marking engine 14 for duplex printing. The details of practicing parallel simplex printing and duplex printing through tandemly arranged marking engines are known and can be generally appreciated with reference to the foregoing cited U.S. Pat. No. 5,568,246. In order to maximize marking paper handling reliability and to simplify system jam clearance, the marking engines are often run in a simplex mode. The sheets exit the marking engine image-side up so they must be inverted before compiling in the finisher 16. Control station 30 allows an operator to selectively control the details of a desired print job.

The marking engines 12, 14 shown in FIG. 1 are conventional in this general illustration and include a plurality of document feeder trays 32 for holding different sizes of documents that can receive print markings by the marking engine portion 34. The documents are transported to the marking engine portion along a highway path 36, 40, and/or 42 which is common to a plurality of the trays 32. It is to be appreciated that any document or media transport path within any of the alternative embodiments outside of the image transfer zone of the marking engine should be considered a high speed highway of document transports. By "highway" path portions is meant those document transport paths where the document is transported at a relatively high speed. For example, in a parallel printing system the sheets are transported through the marking engines at an optimum velocity, but in order to merge the sheets from two or more marking engines together without overlapping them, the sheets must be accelerated up to a higher velocity. A similar situation occurs when providing a stream of blank media to two or more marking engines. The velocity of the highways is therefore generally higher than the velocity used in the marking engines. A plurality of nip drive rollers associated with process direction drive motors, position sensors and their associated control assemblies (belts, guide rods, frames, etc.) cause the transport of documents through the system at the selected highway speed. Documents printed by the marking engine generally must be transported at a slower speed than the highway through the image transfer zone of the marking engine. The image transfer zone can be considered to be that portion of the marking engine 34 in which some portion of the sheet is in the process of having an image transferred to it and in some marking engines, fused. The marking engines 12, 14 can be shown to include a selective inverter assembly 50 as useful for duplex printing of a document by the same engine or bypassing of the inverting function. More particularly, after one side of a document is printed, it can be transported to the inverter assembly 50 where it can be inverted and then communicated back to the image transfer zone by duplex path 52. Alternatively, the document can be non-inverted and then communicated back to the highway path.

Figure 2A:
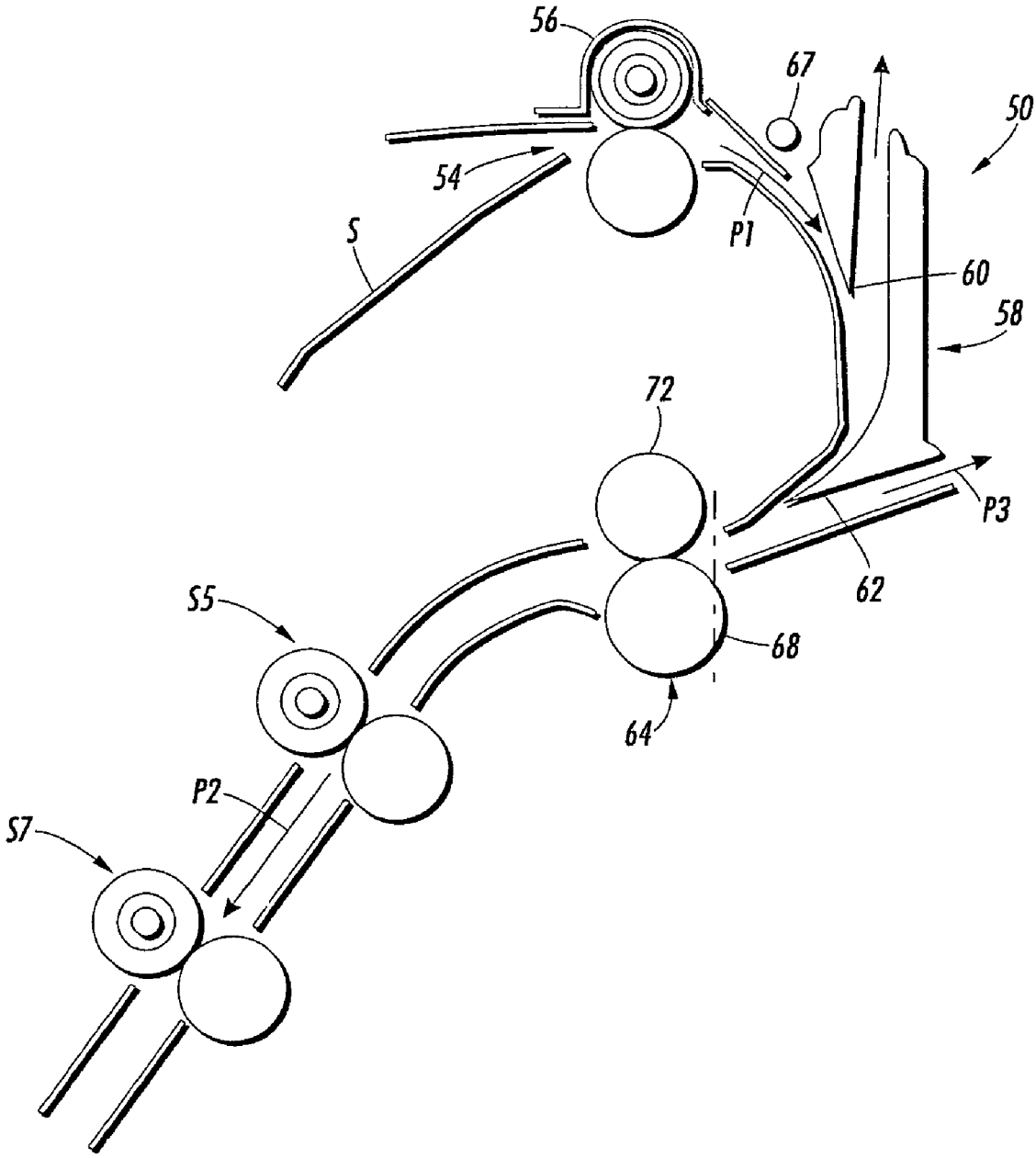
FIG. 2A is a schematic cross-sectional illustration of a selective inverter assembly as may be employed within the system of FIG. 1.
Figure 2B:
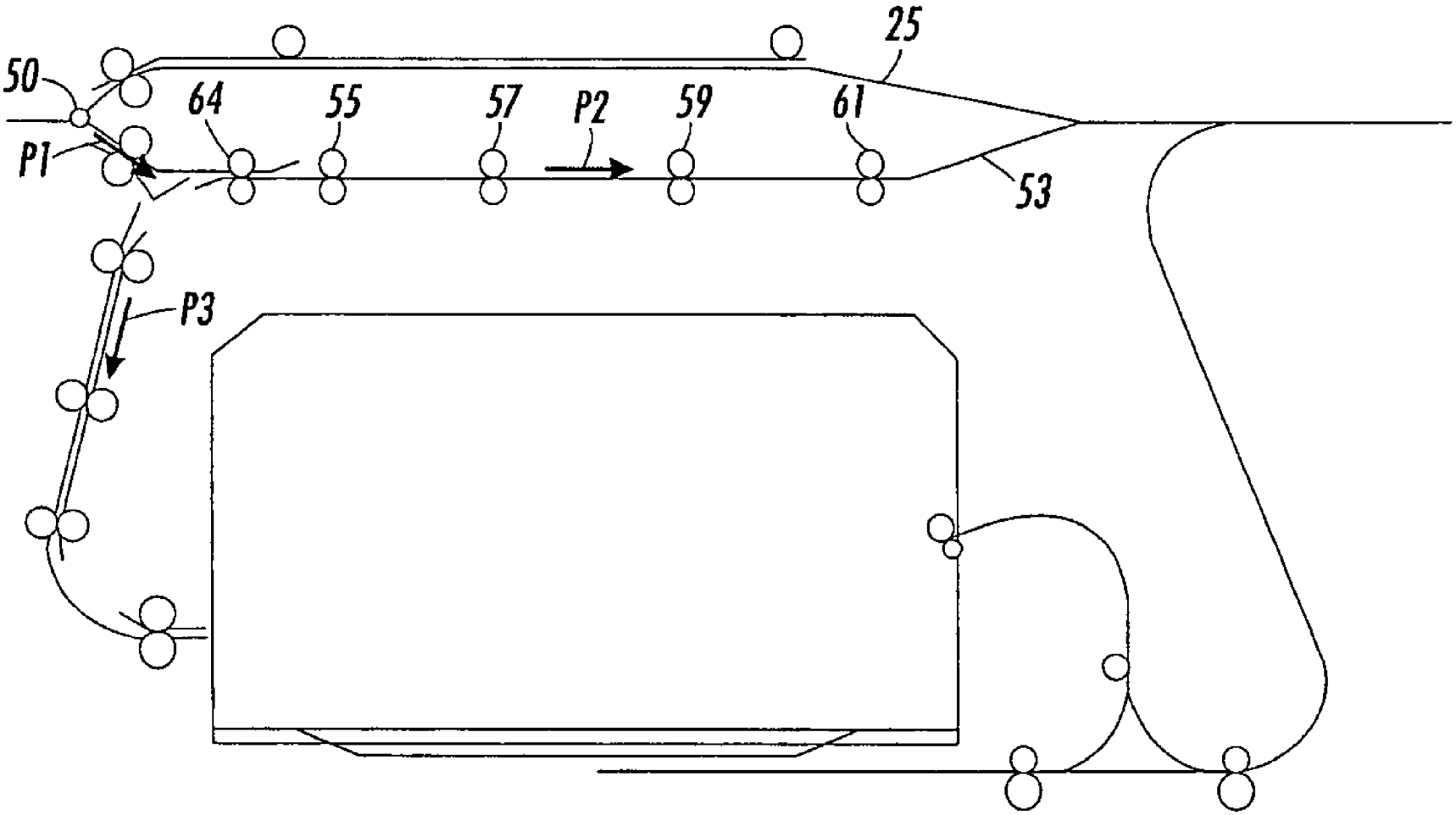
FIG. 2B is a schematic view of a single marking engine as shown in FIG. 1, more particularly illustrating a return path exiting the inverter.

With reference to FIGS. 2A and 2B, a more detailed view of the selective inverter assembly 50 is shown in schematic cross-section. It is to be appreciated that the details to be described hereinafter regarding inverter assembly 50 can also be applied to other inverter assembly configurations, i.e. inverter 63 (FIG. 1). A document or sheet S transported into the inverter assembly at sheet entrance 54 is grasped by inverter assembly input or inverter nip rollers 56 and communicated along an input or ingress path P1 through a gate assembly 58 past simplex gate 60 and duplex gate 62 into the reversing roll nips 64, 66. Sensor 67 identifies when a document that is received in the inverter assembly has cleared the inverter nip rollers 56, so that it can be exclusively grasped by the reversing nip rollers 64, 66 and thereby effectively decoupled from the upstream paths from the sheet entrance 54, whether they be a highway path 25 or an image transfer zone path. More importantly, when a document is exclusively grasped by the reversing nip rollers 64, 66 its speed can be set independent of the speed with which the document is received at the inverter nip rollers 56. The reversing nip rollers 64, 66 can be driven in a different speed when the document is released by the inverter nip rollers 56 to enable a velocity buffering between desired different speeds about the selective inverter assembly and/or staging of the document in a return path 53 as will hereinafter be more fully explained.

The selective inverter 50 includes the input path P1, a first output or egress path P2, and a second output or egress path P3. The first output path P2 comprises the return path portion 53 for returning media sheets non-inverted to the highway path 25 and/or staging select media sheets prior to returning them to the highway path 25. In particular, media sheets can be communicated in a forward direction into the inverter assembly 50, through the selectively reversing nip rollers 64, 66, and passed in the same forward direction to transport rollers 55, 57, 59, 61 along path P2. It is to be appreciated that path P2 and return path 53 combine to enable at least one sheet to be staged prior to being transported back to the highway path 25.

Alternatively, media sheets can be inverted by the selectively reversing nip rollers in the inverter assembly 50 and communicated in a reverse direction along second output path P3. The media sheets communicated in this direction can be transported past duplex gate 62 and onward for example, to a downstream marking engine for duplex printing. It is to be appreciated that the inverting of media sheets and transporting of same through the second output path P3 can occur while other media sheets are staged along first output path P2.

Figure 3:
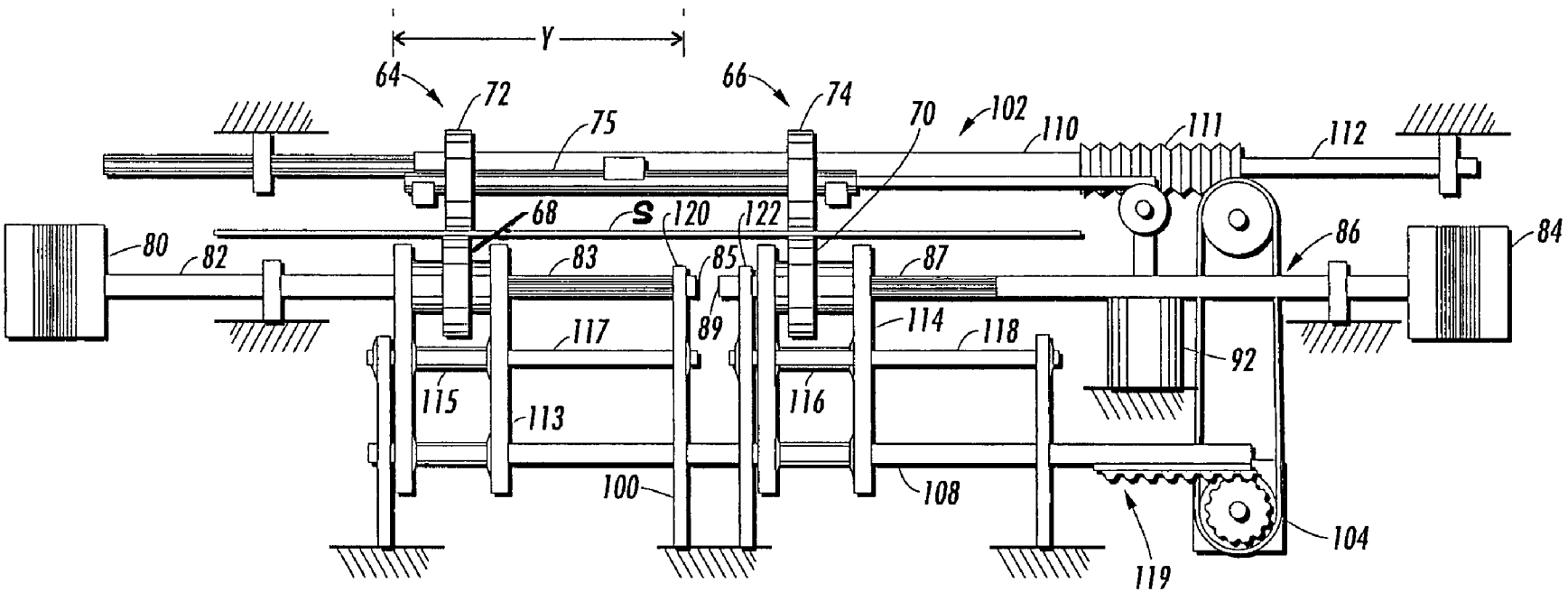
FIG. 3 is an elevational view of an inverter nip assembly as shown in FIG. 2A; and, FIG. 4 shows a top view of the deskewing and alternative paths of selected documents through the inverter assembly.

FIG. 3 is an elevational view of the inverter assembly 50 of FIG. 2B more particularly illustrating the details of the subject embodiment of the inverter assembly and with particular illustration of the drive mechanisms. The pair of selectively reversing nip rollers 64, 66 comprise nip drive rollers 68, 70 and opposed nip idler rollers 72, 74 which together serve to grasp the document or media sheets being transferred between the rollers 64, 66. The nip drive roller shaft can comprise two different nip drive roller shafts each independently driven by separate motors to effect the desired deskewing operation. More particularly, first nip process direction motor 80 effectively drives first nip drive roller shaft 82 and a second nip process direction motor 84 drives second nip drive roller shaft 86. Nip drive rollers 68, 70 are mounted respectively on the shafts 82, 86 opposite nip idler rollers 72, 74 so that a sheet grasped between the nip drive rollers 68, 70 and nip idler rollers 72, 74 can be deskewed when the motors 80, 84 drive the rollers 68, 70 at different speeds.

Idler rollers 72, 74 can be connected by a rod 75. A solenoidal release mechanism 92 can release the nip idler rollers 72, 74 from grasping engagement with the drive rollers 68, 70 by actuating rod 75 to enable communication of select sheets non-inverted to transport rollers 55, 57, 59, 61 along first output path P2 after sheet registration has been completed. A stationary frame 100 supports a substantial portion of the inverter assembly 50 against process direction movement, but allows a process direction motor as mounted in a translating carriage frame 102 to be moved in a cross-process direction for adjusting the position of a document within the inverter assembly to accomplish the registering function. More particularly, a translating drive motor (not shown) mounted on the stationary frame 100 is connected to the translating carriage frame 102 via belt drive 104 for translating nip drive rollers 68, 70, nip idler rollers 72, 74 and the other elements mounted on the translating frame 102 in a cross-process direction by shifting guide or translating rods 108, 110 of the translating frame 102. In other words, as the translating motor moves the translating frame 102, the guide rods 108, 110 will correspondingly translate relative to the stationary frame 100 in a cross-process directional manner shown by arrow "Y". Translating rod 110 can include a round rack 111 which is driven by belt drive 104. Rod 111 translates over fixed rod 112. Motor shafts 82, 86 include external splines 83, 87 upon which drive rolls 68, 70 translate. The drive rolls 68, 70 are connected to translating rod 108 by mounts 113, 114. Mounts 113, 114 include hollow shafts 115, 116 which can translate over another pair of fixed rods 117, 118 when translating rod 108 is driven by a lateral shift rack 119 which can be actuated by belt drive 104.

It is to be appreciated that the entire translating portion shown as shown in FIG. 3 comprises only a portion of the overall inverter assembly 50. In the subject embodiment, the selectively reversing nip rollers 64, 66 can be used for selectively inverting, deskewing, and registering process either during the ingress of a document to the translating portion, its egress therefrom, or during both ingress and egress. The registering comprises simultaneously laterally shifting of the document via the cross-process translating of the translating frame 102, and deskewing of the documents by driving each of the nip drive rollers 68, 70 at differential velocities. The details of lateral shifting and deskewing operations are described below.

Figure 4:
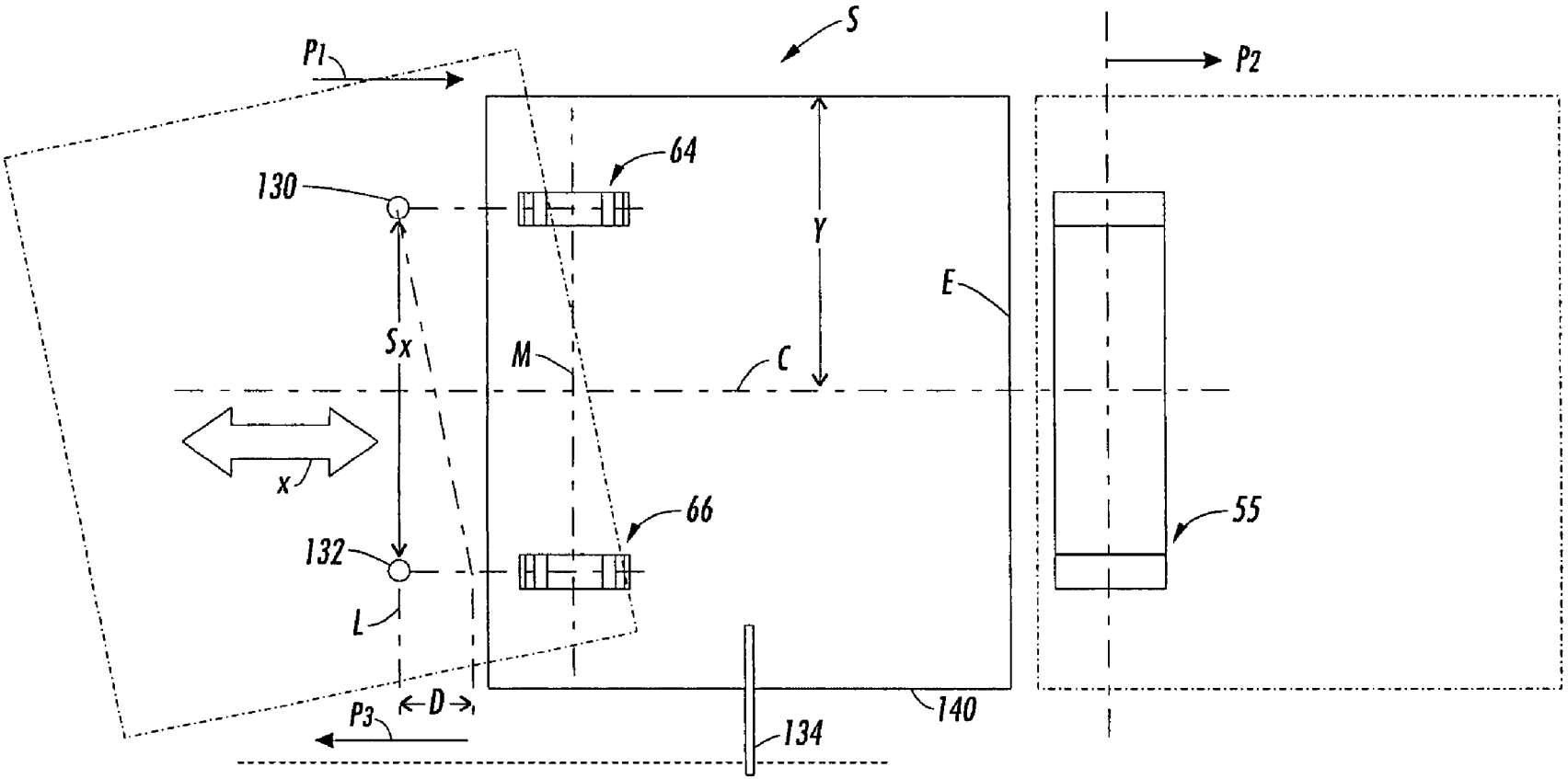

Referring now to FIGS. 3 and 4, sheet S can be advanced along ingress paper path P1, which may be any curvilinear surface over which paper sheets will be passed, into the pair of nip roll pairs 64 and 66, each respectively comprising driving rollers and idler rollers which frictionally engage sheet S therebetween. The driving and idler rollers are generally provided with a rubber or plastic surface suitable for substantially non-slipping engagement of sheets passed therebetween. Driving rollers are respectively supported for controllable rotating driving motion on roller shafts 82 and 86. Roller shafts 82 and 86 can be drivingly engaged to independently control drive means such as motors 80 and 84, The shafts 82, 86, can be supported at one end 85, 89 by frame mounts 120, 122, and at the other end by motors 80 and 84, respectively. Motors 80 and 84 are generally similar in construction and operational characteristics, and in one particularly advantageous embodiment comprise stepper motors. One suitable stepper motor is a Sigma Corporation, Series 20 stepper motor having a resolution of 200 step/rev. This motor is only one example of many possible devices suitable for the intended application.

Paper paths P1, P2, P3 can be provided with a series of at least three sensors, 130, 132, 134. Sensors 130 and 132 are suitably spaced on a line L arranged generally perpendicularly to the path of paper sheet travel (x-or process direction). In one embodiment the spacing can be about 9 inches apart, and each spaced approximately equidistant from a paper path centerline C. Sensor 134 is located at a position where one side edge 140 of a paper sheet S will pass, for detection by the sensor. In one embodiment, this may be slightly downstream from sensors 130 and 132, between 10 mm and 70 mm further away from a line M connecting nip roll pairs 64 and 66. In one working example, sensor 134 was spaced 40 mm downstream from line M. It will be appreciated that what is necessary in the positioning of sensor 134 is that the position allows detection of the sheet side edge 140 subsequent to, or simultaneous with, skew detection, and accordingly, upstream or downstream positions are well within the scope of the exemplary embodiments. Sensors 130 and 132 may be advantageously comprised of reflective optical sensors which will produce a signal upon occlusion by paper sheets or the like. Other dimensions and positions of the sensors and nip roll pairs with respect to each other are possible. The above are given as examples only.

As sheet S enters the deskewing arrangement and is advanced through nip roll pairs 64, 66, lead edge E occludes sensors 130 and 132. Which sensor is occluded first depends on the direction of skew of the sheet, and it is entirely possible that the sheet will occlude both sensors 130 and 132 substantially simultaneously, thereby indicating no skew in the sheet. In either event, on occlusion, the sensors 130, 132 pass a signal to a controller system as will be described.

It is to be appreciated that a control system suitable for use in the exemplary embodiments is used in conjunction with the drive motors and sensors. A controller controls operations of the reproduction machine, or a portion thereof, as is well known in the art of reproduction machine control, and may be comprised of a microprocessor capable of executing control instruction in accordance with a predetermined sequence, and subject to sensed parameters, and producing a controlling output in response thereto. For the exemplary embodiments, an Intel 8051 microcontroller is a satisfactory microprocessor for control of, for example, a sheet registration subsystem of a reproduction machine. Other alternatives are, of course, available.

Sensors 130, 132, and 134 provide control signals to the control system to provide sensing information, from which information, operation of the driving rollers 68 and 70 will be controlled. Additionally, the controller drives the stepper motors 80 and 84 in accordance with the required movement and rotational velocity of driving rollers 64 and 66. In one typical example, stepper motors 80 and 84 are advantageously driven in a halfstep mode, although full step or microstep modes of operation could be used. Motor revolutions can thus be divided into a large number of halfsteps, each halfstep providing an exact increment of rotation movement of the motor shafts 82 and 86, and thus the driving rollers 68 and 70. In accordance with this scheme, a pair of motor driver boards (not shown), provide a pulse train to incrementally drive motors 80 and 84.

With reference again to FIG. 4, the deskew and side registration process will now be described more specifically. Sheet S having an unknown amount of skew a (not illustrated) enters the nip roll pairs 64 and 66 and is driven non-differentially thereby, at a constant velocity Vo. As it is advanced, lead edge E passes by and occludes either of sensors 130 or 132. For the purpose of the description, it will be assumed that 132 is occluded by lead edge E first. Sensor 132 provides an occlusion signal to the controller, whereby, the controller commences counting the halfsteps generated by motor driver boards as sheet S is driven non-differentially through the nips by motors 80 and 84, past sensor 132, and recording the number of halfsteps counted until sensor 130 also indicates occlusion by sheet lead edge E. As there is assumed to be a linear relationship between the number of motor halfsteps counted and travel by the sheet lead edge E, it can be seen that: N=D/K (1) where, N=number of motor halfsteps; K=a constant equal to the advancement of the driving roller surface for each motor halfstep; and D=the difference distance traveled by the portion of the sheet which originally occluded 132 until 130 is occluded. Thus, it can also be seen that a=tan-1D/Sx (2) or for small angles a=D/Sx (3) where, a=the random skew angle of a sheet entering the nips; and Sx=distance between sensors 130 and 132.

Because K and Sx are constants for a particular registration subsystem, a sufficient measure of the skew angle of the sheet as it enters the registration and deskewing arrangement is simply N, the number of motor halfsteps taken between occlusion of sensor 130 and sensor 132, while the motors are driven non-differentially.

With the skew angle a of the sheet known, the sheet is rotated in a selected direction, for example clockwise looking down on FIG. 4, to compensate for the skew angle a. This rotation is accomplished simultaneously with continuing advancement along paper path P1. It is to be appreciated that when the sheet first enters the nips 64 and 66, both motors 80 and 84, are operating at substantially similar speed to drive the sheet non-differentially at a velocity Vo, at T1, sensor 132 is occluded by lead edge E of sheet S, while at T2, sensor 130 is similarly occluded. In accordance with the detected random skew angle a of the sheet, motor 80 is driven at an increased velocity V2 while motor 84 is driven at a decreased velocity V1.

After skew correction, the sheet is driven non-differentially by the motors 80 and 84. In one embodiment, a fourth sensor (not shown) can be provided downstream from the deskewing arrangement along paper path P1. The time of occlusion of this sensor is sensed with respect to a machine norm, or the status of other machine processes, such as the position of the latent image on the photoreceptor, with respect to the transfer station. Knowing this comparison, the non-differential driving velocity of motors 80 and 84 may be increased or decreased to appropriately register the sheet with a machine operation in the X-direction. It will, of course, be appreciated that this information is also derivable from already known information, i.e. the time of occlusion of 130, 132, and 134, as well as the driving velocities of the motors acting on the sheet.

In still another embodiment, the deskewing may be done over a length of paper path. At particularly high sheet speeds, the paper may not be engaged with a the nip pair set long enough to correct for the initial skew, side register and then register the sheet in the process direction of the sheet. Accordingly, it is well within the scope of the exemplary embodiments to distribute skew correction and side registration at one set of nip rolls pairs and to accomplish process direction registration at a subsequent set of nip roll pairs along paper paths P1 and P2 or paper paths P1 and P3.

The subject embodiments enable very high registration latitudes (deskew, top edge registration and lead edge registration), since simultaneous corrections can be made while a sheet both enters and exits the inverter assembly along paths P1 and P3. By the nature of the inversion process, sheets entering the inverter assemblies are registered using the lead edge of the sheet (the lead edge becomes the trailing edge when sheets exit along Path P3) to correct for any feeding/transporting registration errors. The removal of skew and lateral registration errors could be done while the sheet enters and exits the inverter, or the primary errors could be removed during the entrance phase and additional top edge and skew corrections could be made as the sheet exits the inverter (to correct for cut sheets and trailing edge/leading edge registration induced errors). Such a capability puts less stringent registration requirements on the feeders and other transports and thereby lowers overall system costs and enhances system reliability and robustness.

With reference again to FIG. 1, it can be seen that the vertical transport modules 18 and 20 both include inverter assemblies 63 while the marking engines 12-14 each include additional inverter assemblies 50 adjacent the exit to the image transfer zone. The inverters 50, 63 can include non-reversing exit paths P2 and return paths 53, 65 out of the back of the inverters. Gross amounts of mis-registration can be corrected while media passes through the inverters which can then be returned to a highway (i.e. highway 25) to be printed by another print engine or exited from the system. As discussed above, the exit paths P2 can be used as sheet buffers and sheet stagers/sequencers, i.e. temporary sheet storage. The staging and re-sequencing of selected media can be manipulated while selected other media can be inverted in one or more of the inverters. Exit path P2 may also be used as a highway bypass or 'detour' should a media jam occur on the main highway immediately adjacent to exit path P2.

By adding an alternative exit path to inverter/registration subsystems, it becomes possible to correct a grossly mis-registered sheet by diverting it off the highway, register the sheet in the inverter, and then send the sheet in the same direction (non-inverted) so that it merges back onto the highway. This provides the system scheduler/controller both with a tool to correct sheet registration degradation at the system level as well as a sheet stager for re-sequencing sheets in a print job. The disposition of such a plurality of inverter assemblies within the overall printing system provides options for implementing desired registering, velocity buffering, selective inverting, staging, and re-sequencing of documents being transported through the system.

The operation of the aforementioned arrangement can include the following. The system measures mis-registration and tags sheets having significant mis-registration. The problem sheet is diverted off the highway towards an input inverter having the configuration shown in FIGS. 2A, 2B, and 4. The sheet leading edge passes over the skew sensors, and then the lateral registration sensor. At this point, the exact amount of mis-registration is known. Also at this point, the inverter transport rollers are in their normal open condition. The sheet is re-registered while in the reversing rollers 64, 66, at which point a first pair of inverter transport rollers 55 are closed and the sheet is handed off to the inverter transport rollers 55, 57, 59, 61. Depending upon the directives from the system scheduler, the sheet can be immediately returned to the high speed highway 25, or paused until a 'slot' on the highway 25 is available. Once the sheet is returned to the high speed highway 25, the inverter transport rollers 55, 57, 59, 61 are returned to the open position.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a marking engine and a document transport highway path;

an inverter including an input path and selectively reversing inverter rollers whereby selected ones of media sheets move from said transport highway path through said input path;

said selectively reversing inverter rollers include a first drive nip assembly and at least a second drive nip assembly, said first drive nip assembly driven at a first velocity and said second drive nip assembly driven at a second velocity;

said first velocity different from said second velocity so as to deskew a media sheet simultaneously as said media sheet enters and exits said inverter; and, said inverter further includes a first output path, said first output path having a return path whereby said selected ones of media sheets move in a forward direction through said input path and non-inverted in same said forward direction through said first output path and said return path to said transport highway path.

2. The printing system of claim 1, wherein said first drive nip assembly and said second drive nip assembly each have independently driven rollers.

3. The printing system of claim 1, wherein said inverter further includes a second output path whereby selected others of media sheets move inverted in a reverse direction through said second output path.

4. The printing system of claim 1, wherein said selectively reversing inverter rollers includes a pair of nip idler rollers opposed to a pair of selectively reversing nip drive rollers, and a nip release mechanism for simultaneously disengaging ones of the drive or idler rollers from media sheet grasp.

5. The printing system of claim 1, wherein said reversing inverter rollers include at least two drive motors that can be driven with differential velocities so as to register the media in said forward direction and in a reverse direction.

6. The printing system of claim 5, wherein the registering comprises at least one of cross-process translating, deskewing and process direction translating.

7. The printing system of claim 1, wherein said return path includes nip drive rollers to move said selected ones of media sheets in same said forward direction.

8. The printing system of claim 1, wherein said return path includes nip drive rollers to stage at least one of said selected ones of media sheets.

9. The printing system of claim 1, wherein said first drive nip assembly and at least said second drive nip assembly simultaneously translated to register media in a cross process direction.

10. The printing system of claim 1, wherein the media movement through the return path is performed by a drive nip system adjacent to said selectively reversing inverter rollers.

11. The printing system of claim 10, in which said selectively reversing inverter rollers are released during the media movement through said first output path.

12. The printing system of claim 1, said transport highway path is comprised of a first set of nip rollers spaced from said selectively reversing inverter rollers for independent control of said media sheets.

13. The printing system of claim 1, wherein said marking engine is associated with an input inverter, said input inverter can receive said media sheets from said transport highway path while being transported at a first speed and transport said selected ones of media sheets non-inverted back to said transport highway path at same said first speed.

14. The system of claim 1, wherein the selectively registering the media is achieved during media ingress and egress from the inverter assemblies.

15. An inverter apparatus comprising:

an inverter having selectively reversing inverter rollers, an input path, and a first output path;

said first output path further includes a return path whereby selected ones of media sheets move in a forward direction through said input path and non-inverted in same said forward direction through said first output path and said return path;

said inverter further includes a second output path whereby selected other ones of media sheets move inverted in a reverse direction through said second output path;

said selectively reversing inverter rollers include a first drive nip assembly and at least a second drive nip assembly, said first drive nip assembly selectively driven at a first velocity and said second drive nip assembly selectively driven at a second velocity;

said first velocity different from said second velocity so as to deskew a media sheet simultaneously as said media sheet enters and exits said inverter selectively through said first output path or said second output path.

16. The inverter apparatus of claim 15, wherein said return path includes a pair of drive nips for moving said selected ones of media sheets in same said forward direction.

17. The inverter apparatus of claim 15, wherein said return path includes a staging portion for staging at least one of said selected ones of media sheets.

18. The inverter apparatus of claim 15, wherein the inverter apparatus is disposed adjacent an entrance of an image transfer zone of the marking engine.

19. The inverter apparatus of claim 15, wherein the inverter further includes an inverter path for moving said selected other ones of media sheets inverted in a reverse direction during egress of the document from the inverter.

20. A xerographic imaging system comprising:

a transport highway media path for selectively moving a document and transporting said document into a selective inverter assembly in a forward direction;

said selective inverter assembly transports selected ones of said documents out of said selective inverter assembly in a non-inverted orientation to said transport highway path in same said forward direction; and, said selective inverter assembly includes a first drive nip assembly and at least a second drive nip assembly, said first drive nip assembly selectively driven at a first velocity and said second drive nip assembly selectively driven at a second velocity to register said selected ones of said documents within said selective inverter assembly wherein said registering comprises at least one of cross-process translating and deskewing.

21. The imaging system of claim 20, wherein said selective inverter assembly transports selected other ones of said documents out of said selective inverter assembly in an inverted orientation to a marking engine in a reverse direction.

22. The imaging system of claim 21, wherein said selective inverter assembly further includes a first output path and a second output path, said selected ones of said documents move through said first output path in said forward direction and said selected other ones of said documents move through said second output path in said reverse direction.

23. The imaging system of claim 22, wherein said selective inverter assembly stages selected ones of said documents in said first output path prior to transporting to said transport highway path.

24. The imaging system of claim 20, wherein removal of said selected ones of said documents from said transport highway path is at a first position and return to said transport highway path is at a re-sequenced second position.

25. The imaging system of claim 20, wherein said selective inverter assembly registers said selected ones and said selected other ones of said documents within said selective inverter assembly wherein said registering comprises at least one of cross-process translating, deskewing, and process direction translating.

26. The imaging system of claim 25, wherein said selective inverter assembly further includes at least two sensors for sensing deskew of said documents and a third sensor for sensing lateral registration of said documents wherein said registering further comprises simultaneous cross-process translating and deskewing of said documents.

* * * * *